United States Patent [19]

Itoh

[11] 4,137,859

[45] Feb. 6, 1979

[54] SLIDE FASTENER AND A METHOD OF ATTACHING THE SAME TO A GARMENT

[75] Inventor: Kenichiro Itoh, Juegesheim, Fed. Rep. of Germany

[73] Assignee: Yoshida Kogyo K K, Tokyo, Japan

[21] Appl. No.: 795,858

[22] Filed: May 11, 1977

[30] Foreign Application Priority Data

May 15, 1976 [JP] Japan ..... 51-55663

[51] Int. Cl.[2] ..... D05B 3/12

[52] U.S. Cl. ..... 112/265

[58] Field of Search ..... 24/205.16 R, 205.16 C; 2/265; 112/265

[56] References Cited

U.S. PATENT DOCUMENTS

| | | | |
|---|---|---|---|
| 3,003,445 | 10/1961 | Crystal | 2/265 |
| 3,456,305 | 7/1969 | Voit | 112/265 |
| 3,710,745 | 1/1973 | Yoshikawi | 112/265 |
| 3,793,683 | 2/1974 | Thaeler | 2/265 |
| 3,866,275 | 2/1975 | Amburg | 2/265 |

*Primary Examiner*—Werner H. Schroeder
*Assistant Examiner*—Doris L. Troutman
*Attorney, Agent, or Firm*—Bucknam and Archer

[57] ABSTRACT

A method of attaching a slide fastener to a garment having a slotted closure opening of a given length is disclosed. Rows of fastener elements, carried on and along confronting longitudinal edges of a pair of stringer tapes are interengaged to couple the same. The stringer tapes are longer than the closure opening. A slider is mounted onto the interengaged rows of fastener elements at their lower ends. The rows of fastener elements are interengaged over their entire length except for a region of disengagement resulting from the placement of a slider and located thereat. The garment is turned inside out. The coupled stringer tapes are placed onto the garment in such a manner that the outer surfaces of the coupled stringer tapes are mated with opposed inner marginal portions of the closure opening, with the interengaged rows of fastener elements in alignment with the closure opening, and with the slider disposed downwardly of the lower end of the closure opening. The coupled stringer tapes are sewn respectively to the opposed inner marginal portions by lines of stitching except at the lower portions thereof extending downwardly of the lower end of the closure opening. The slider is moved upwardly beyond the lower end of the closure opening.

2 Claims, 9 Drawing Figures

SLIDE FASTENER AND A METHOD OF ATTACHING THE SAME TO A GARMENT

BACKGROUND OF THE INVENTION

1. Field of the Invention

This invention relates to the application of slide fasteners to garments having a slotted closure opening.

2. Prior Art

One of the methods commonly employed in applying slide fasteners to garments having a closure opening comprises the steps of sewing a pair of stringer tapes one by one to opposed marginal portions of the closure opening, applying a slider to the stringer tapes so as to be movable along rows of interengageable fastener elements carried on and along confronting longitudinal edges of the stringer tapes, and attaching a pair of upper and lower end stop means to the stringer tapes at their opposite ends, respectively. This method requires a lot of time and effort.

Another method is known in the art in which a finished slide fastener is attached to a garment. A slide fastener is first placed on a garment with interengaged rows of fastener elements in alignment with a closure opening in the garment. Then, the associated slider is moved downwardly toward the lower end stop member so that the slider will not make contact with a presser foot of a sewing machine to prohibit it from interfering with the sewing operation. The slider is again moved upwardly toward the upper end stop means to locate it at the portions of the stringer tapes which have been sewn to opposed marginal portions of the closure opening so that the slider will not interfere with the subsequent sewing operation. This is time consuming and involves additional labor because the slider has to be moved downwardly and upwardly during the sewing operation. Further, with this conventional method, the lines of stitching are subject to disturbance since the sewing operation is interrupted.

SUMMARY OF THE INVENTION

With the aforesaid difficulties of the prior art in view, it is the primary object of the present invention to provide a method of applying a slide fastener to a garment having a closure opening in which a slide fastener is sewn to the garment with utmost ease and speed.

Another object is to provide such a method in which the lines of stitching by which a slide fastener is sewn to a garment are arranged in an orderly fashion.

A further object is to provide a slide fastener suitable for use in performing such a method.

According to a first aspect of the invention, there is provided a slide fastener comprises a pair of stringer tapes having rows of interengageable fastener elements carried respectively on and along their confronting longitudinal edges. A slider is reciprocable along the rows of fastener elements to couple and uncouple the stringer tapes to close and open the slide fastener. The slider is disposed adjacent to and spaced away from the lower ends of the rows of fastener elements. The rows of fastener elements are interengaged at the opposite sides of the slider.

According to a second aspect, there is provided a garment having a slotted closure opening of a given length. The garment comprises a slide fastener including a pair of stringer tapes carrying on and along their confronting longitudinal edges rows of interengageable fastener elements. The stringer tapes are longer than the closure opening. The stringer tapes are sewn to opposed inner marginal portions of the closure opening except at the lower portions thereof which extends downwardly beyond the lower end of the closure opening. A slider is reciprocable along the rows of fastener elements to couple and uncouple the stringer tapes. The slider is positionable downwardly of the lower end of the closure opening.

According to a third aspect, there is provided a method of attaching a slide fastener to a garment having a slotted closure opening of a given length. The method comprises the steps of: (a) interengaging rows of fastener elements, carried on and along confronting longitudinal edges of a pair of stringer tapes, to couple the same, the stringer tapes being longer than the closure opening; (b) mounting a slider onto the interengaged rows of fastener elements at their lower ends; (c) turning the garment inside out; (d) placing the coupled stringer tapes onto the garment in such a manner that the outer surfaces of the coupled stringer tapes are mated with opposed inner marginal portions of the closure opening, with the interengaged rows of fastener elements in alignment with the closure opening, and with the slider disposed downwardly of the lower end of the closure opening; (e) sewing the coupled stringer tapes respectively to the opposed inner marginal portions by lines of stitching except at the lower portions thereof extending downwardly of the lower end of the closure opening; and (f) moving the slider upwardly beyond the lower end of the closure opening.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF PREFERRED EMBODIMENTS

Figure 1:
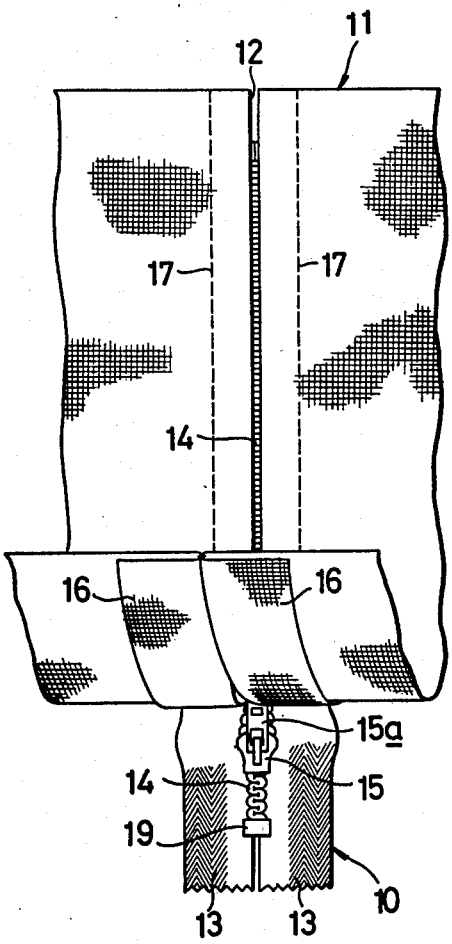
FIG. 1 is a plan view of a garment to which a slide fastener in accordance with the invention is attached.

FIG. 1 shows a slide fastener 10 of this invention attached to a garment 11 having a slotted closure opening 12, the slide fastener 10 having a pair of identical stringer tapes 13, 13 carrying on and along their confronting longitudinal edges rows of fastener elements 14, and a slider 15 reciprocable along the rows of fastener elements 14 to couple and uncouple the stringer tapes to thereby close and open the slide fastener 10 and hence the closure opening 12. The stringer tapes 13, 13 are sewn to folded, opposed inner marginal portions 16,16 (FIGS. 2 and 2*a*) of the closure opening 12 by a pair of lines of stitching 17,17 passing therethrough, with the outer surfaces of the stringer tapes 13,13 mated with the inner marginal portions 16,16 respectively, as best seen in FIG. 3 which shows the garment 11 inside out.

Figure 4:
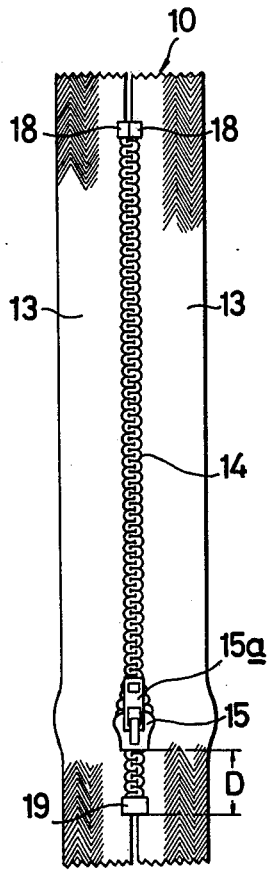
FIG. 4 is a plan view of the slide fastener shown before it is applied to the garment.
Figure 3:
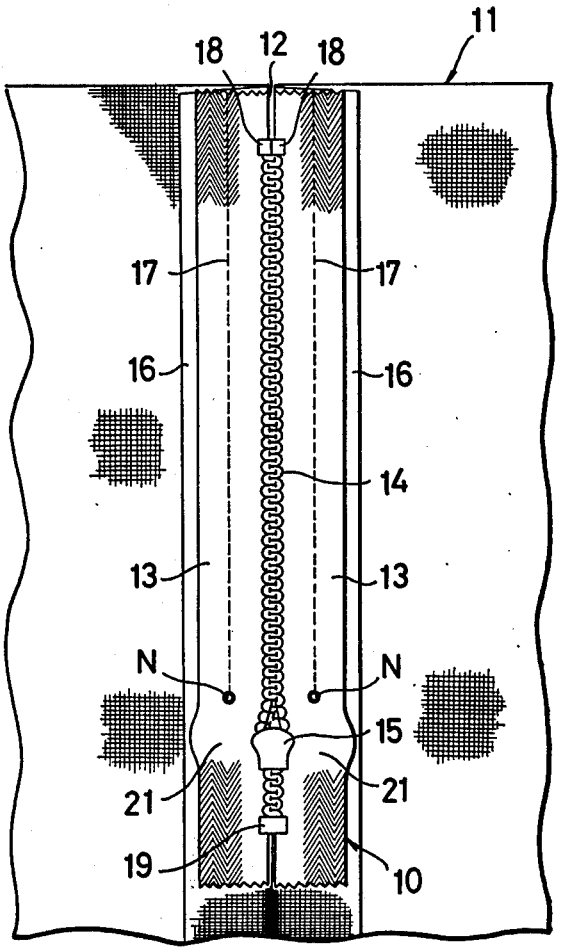
FIG. 3 is a plan view of the garment turned inside out, showing the manner in which the slide fastener is sewn to the garment.

As best shown in FIGS. 3 and 4, a cooperative pair of upper end stop members 18,18 are fixedly secured respectively to the stringer tapes 13,13 immediately adjacent to the upper ends of the rows of fastener elements 14 for limiting the upward or closing movement of the slider 15 therealong. Similarly, a lower end stop member 19 is fixedly secured to and inseparably holds the lower ends of the stringer tapes 13,13 immediately adjacent to the lower ends of the rows of fastener elements 14, for limiting the downward or opening movement of the slider 15 therealong.

The stringer tapes 13,13 are longer than the closure opening 12 so that the lower end stop member 19 is disposed downwardly of the lower end 20 of the opening 12. Each of the lines of stitching 17,17 extends substantially parallel to and coextensive in length with the closed opening 12 so that the lower portion 21 of each of the stringer tapes 13,13 extending downwardly of the lower end 20 of the opening 12 is left unsewn. The length of each of the stringer tapes 13,13 is so related to that of the closure opening 12 that the slider 15 can be disposed downwardly of the lower end 20 of the opening 12 as best shown in FIG. 3.

When the slide fastener 10 is to be applied to the garment 11, the pair of stringer tapes 13,13 are first coupled together by means of a separate slider device (not shown) which moves along the rows of fastener elements 14. Then, the associated slider 15 is mounted onto the interengaged rows of fastener elements 14 at the lower ends thereof.

Figure 2:
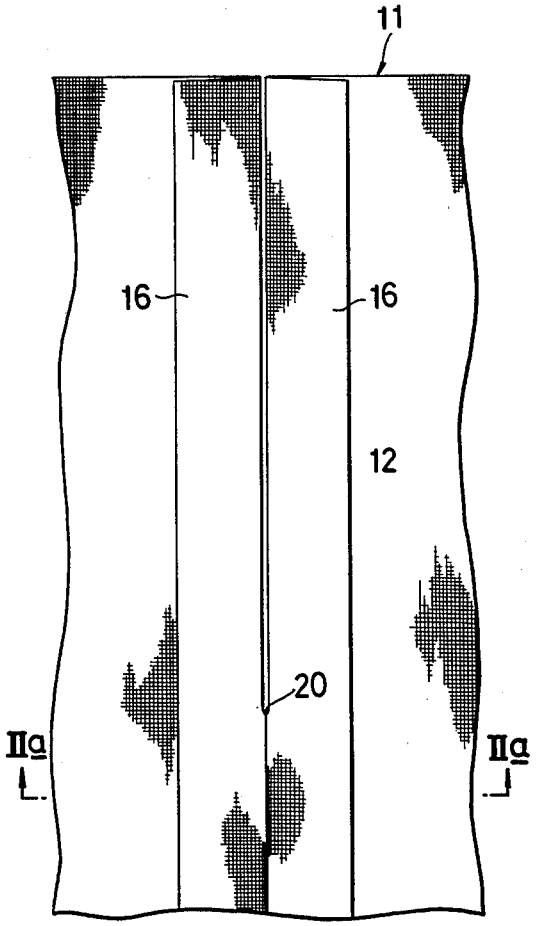
FIG. 2 is a plan view of the garment turned inside out.
Figure 2A:
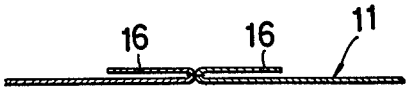
FIG. 2*a* is a cross-sectional view of the garment taken along line II*a* — II*a* of FIG. 2.

The pair of upper end stop members 18,18 and the lower end stop member 19 are attached to the stringer tapes 13,13. Preferably, prior to the attachment of the lower end stop member 19 to the stringer tapes 13,13 the slider 15 is manipulated to move upwardly away from the lower ends of the interengaged rows of fastener elements 14 a distance D (FIG. 4) sufficient to prohibit the slider 15 from interfering with the lower end stop member attaching operation. The distance D is such that the slider 15 is disposed downwardly of the lower end 20 of the closure opening 12 when the thus arranged slide fastener is first applied to the garment 11. Since the slider 15 is moved upwardly, that is to say, in the fastener closing direction, to assume this position, the rows of fastener elements 14 are kept interengaged at opposite sides of the slider 15 as shown in the drawings. Then, the garment 11 is turned inside out as shown in FIG. 2, and the slide fastener 10 is placed on the garment 11 with the outer surface of the coupled stringer tapes 13,13 mated respectively with the opposed inner marginal portions 16,16 of the closure opening 12 and with the interengaged fastener elements 14 in alignment with the closure opening 12. In this condition, the slider 15 is disposed downwardly of the lower end 20 of the closure opening 12. Then, the coupled stringer tapes 13,13 are simultaneously sewn to the opposed inner maginal portions 16,16 of the closure opening 12 by a pair of lines of stitching 17,17, using a sewing machine (not shown) having a pair of sewing needles N,N. The lines of stitching 17,17 are preferably applied from the upper end of the slide fastener 10, but may be applied from the lower end. Also, the pair of lines of stitching 17,17 can be applied one by one, using a sewing machine (not shown) having a singly sewing needle. As mentioned earlier, the lines of stitching 17,17 extend downwardly to the lower end 20 of the closure opening 12. Thereafter, the garment 11 is turned outside out, and by inserting fingers or a suitable tool through the closure opening 12 at the lower end 20 thereof and manipulating the pull tab 15*a*, the slider 15 is moved upwardly to position the same upwardly beyond the lower end 20 of the closure opening 12 so that the slider 15 can readily be manipulated by the wearer of the garment 11 from outside the garment 11 in the usual manner. Since the slider 15 is positioned downwardly of the lower end 20 of the closure opening 12 when the stringer tapes 13,13 are placed on the garment 11, the slider 15 will not make contact with presser foots of the sewing machine and hence will not interfere with the sewing operation. Thus, the sewing operation can be carried out in a continuous, uninterrupted manner. This not only does not disturb the lines of stitching 17,17, but also enable the rapid sewing operation.

Figure 5:
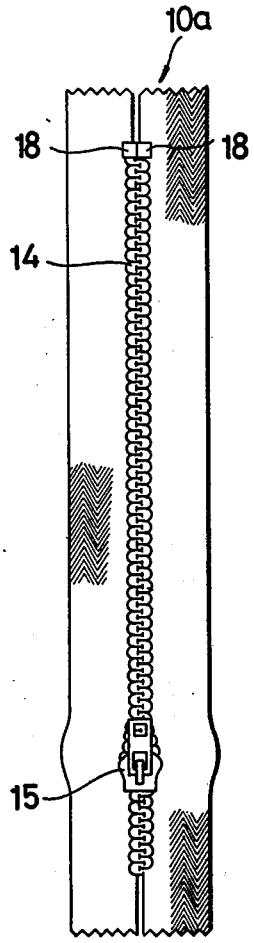
FIGS. 5 to 8 are plan views of modified forms of slide fasteners.
Figure 6:
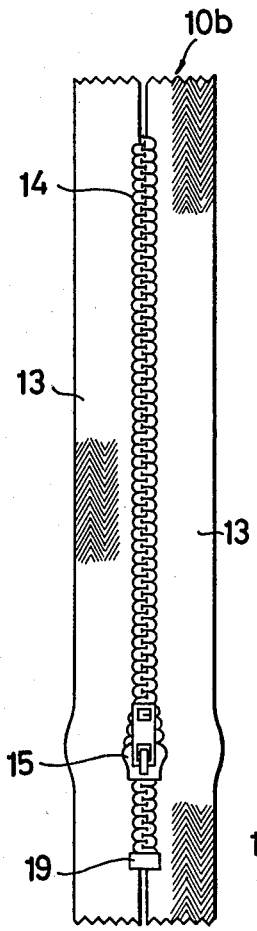
Figure 7:
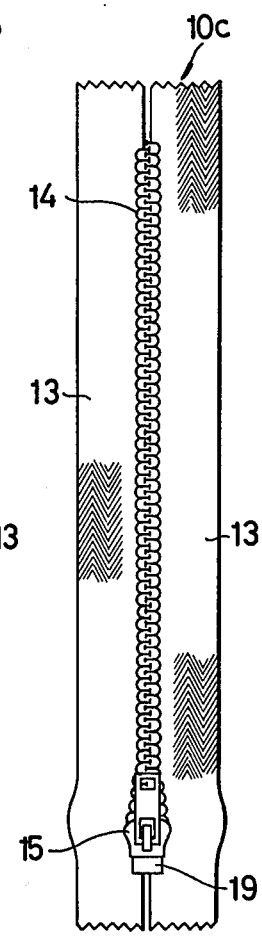
Figure 8:
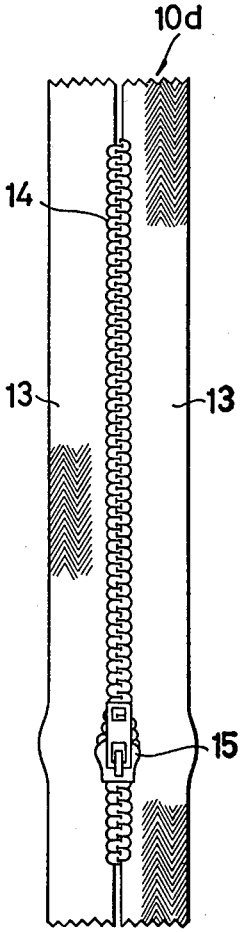

FIGS. 5 to 8 show modified forms of the invention. FIG. 5 shows a slide fastener 10*a* in which the bottom end stop member 19 is omitted. A slide fastener 10*b* shown in FIG. 6 is not provided with the upper end stop members 18,18. A slide fastener 10*c* shown in FIG. 7 differs from the slide fastener 10*b* only in that the slider 15 is held in contact with the bottom end stop member 19. FIG. 8 shows a slide fastener 10*d* in which the upper and lower end stop members 18,19 are omitted. The rows of fastener elements 14 of the slide fastener 10*a* are protected against mismeshing at their lower ends by a line or lines of stitching passing through the stringer tapes 13,13 and extending transversely of the slide fastener 10*a* immediately adjacent to the lower ends of the rows of fastener elements 14. A pair of upper end stop means are provided on each of the slide fasteners 10*b* and 10*c* by inwardly folding the upper end portions of the stringer tapes 13,13, if desired, together with the upper marginal portion of the garment, and sewing the folded tapes and the garment together. The slide fastener 10*d* is processed as described above for the slide fastener 10*a* and the slide fasteners 10*b* and 10*c*.

The artisan will appreciate from FIGS. 3–8, that in the various embodiments of the invention, in the practice of the method according thereto, the rows of fastener elements are interengaged over their entire lengths except on a region of disengagement resulting from the placement of the slider and located thereat. This substantially complete length coupling feature establishes the coupled stringer tapes in a predetermined positional relation to each other so as to prevent misalignment of the stitching lines 17,17.

Although various minor modifications may be suggested by those versed in the art, it should be understood that I wish to embody within the scope of the patent warranted hereon, all such embodiments as reasonably and properly come within the scope of may contribution to the art.

What is claimed is:

1. A method of attaching a slide fastener to a garment having a slotted closure opening of a given length, which method comprises the steps of;

(a) coupling together a pair of stringer tapes each carrying a row of fastener elements extending from a lower end to an upper end on and along its confronting longitudinal edge, said stringer tapes being longer than the closure opening;

(b) mounting a slider onto said already coupled rows of fastener elements at their lower ends, said rows of fastener elements being interengaged over their entire lengths except for a region of disengagement resulting from the placement of the slider and located thereat to thereby establish said coupled stringer tapes in a predetermined positional relation to each other;

(c) turning said garment inside out;

(d) placing said coupled stringer teapes onto said garment in such a manner that the outer surfaces of said coupled stringer tapes are mated with opposed inner marginal portions of the closure opening, with said coupled rows of fastener elements in alignment with the closure opening, and with said slider disposed downwardly of the lower end of the closure opening;

(e) sewing said coupled stringer tapes respectively to said opposed inner marginal portions by lines of stitching simultaneously except at the lower portions thereof extending downwardly of the lower end of the closure opening were said slider is positioned; and (f) moving said slider upwardly beyond the lower end of the closure opening.

2. A method according to claim 1, further comprising the step of applying a pair of upper and lower end stop means to said stringer tapes immediately adjacent to the upper and lower ends of the fastener elements, respectively.

* * * * *